US006113370A

United States Patent [19]

Volftsun

[11] Patent Number: 6,113,370

[45] Date of Patent: Sep. 5, 2000

[54] ROTARY VANE MACHINE

[75] Inventor: Leonid Volftsun, Ofakim, Israel

[73] Assignee: Rototor Ltd., Petach Tikvah, Israel

[21] Appl. No.: 09/242,336

[22] PCT Filed: Aug. 13, 1997

[86] PCT No.: PCT/IL97/00275

§ 371 Date: May 4, 1999

§ 102(e) Date: May 4, 1999

[87] PCT Pub. No.: WO98/07963

PCT Pub. Date: Feb. 26, 1998

[30] Foreign Application Priority Data

Aug. 21, 1996 [IL] Israel ..... 119105

[51] Int. Cl.[7] ..... F01C 1/00

[52] U.S. Cl. ..... 418/38; 418/135; 418/132; 418/34; 418/39; 418/1; 417/204; 123/8.47; 123/56; 123/245

[58] Field of Search ..... 418/38, 135, 132, 418/34, 39, 1; 417/204; 123/8.47, 245, 56

[56] References Cited

U.S. PATENT DOCUMENTS

| | | | |
|---|---|---|---|
| 1,330,629 | 2/1920 | Gooding, Jr. | 418/38 |
| 1,904,892 | 4/1933 | Trube . | |
| 2,271,068 | 1/1942 | Gardner | 418/38 |
| 3,292,602 | 12/1966 | Stewart . | |
| 3,697,201 | 10/1972 | Eckmann | 418/132 |
| 3,776,203 | 12/1973 | Joyce, Sr. | 123/56 |
| 4,334,841 | 6/1982 | Barlow . | |
| 4,416,598 | 11/1983 | Merz | 418/132 |
| 4,664,078 | 5/1987 | Bender | 123/245 |
| 4,687,427 | 8/1987 | Seybold | 418/34 |
| 4,738,235 | 4/1988 | Silvoza | 123/245 |
| 5,181,843 | 1/1993 | Hekman et al. | 418/1 |

FOREIGN PATENT DOCUMENTS

| | | | |
|---|---|---|---|
| 547593 | 3/1928 | Germany | 418/38 |
| 197 010 | 5/1923 | United Kingdom . | |
| 267 565 | 10/1927 | United Kingdom . | |
| 278648 | 3/1928 | United Kingdom | 418/38 |
| 988 003 | 3/1965 | United Kingdom . | |

*Primary Examiner*—Thomas Denion
*Assistant Examiner*—Thai-Ba Trieu
*Attorney, Agent, or Firm*—Lowe Hauptman Gopstein Gilman & Berner

[57] ABSTRACT

The invention provides a rotary-vane machine having a stationary shell including a casing member (2), a camming ring (4) having an internal, noncircular camming surface (6), and a flange member (8); a rotor (10) including at least two first vanes (12) fixedly attached to, or integral with, the rotor (10), a first cover plate (14) fixedly attachable to the rotor (10); a second cover plate (16) fixedly attachable to the rotor and integral with a first shaft (22) supported on its free end by bearing (26) mounted in the casing (2), and being provided with at least four ports (a) for access or egress of a working medium; a second shaft (23) supported by a first bearing (28) accommodated in the first cover plate (14) and by a second bearing (30) accommodated in the second cover plate (16); at least two second vanes (38) fixedly attached to the second shaft (23) and oscillatably accommodated within the rotor (10), and defining, together with the rotor (10), the first vanes (12) and the first and second cover plates (14, 16), a plurality of chambers ($Ch_1$–$Ch_4$); a cross piece (40) integral with the second shaft (23) and having at least one lateral projection (42) mounting at least one block (48) pivotable about a pivot (46); at least one third shaft (32) eccentrically projecting from the second cover plate (16), the end portion of which shaft is connected to a coupling member for connection to a source of rotational power; at least one cam follower (54) pivotably mounted between the second cover plate (16) and the coupling member on the at least one third shaft (32) and comprising two rollers (60) riding along the internal surface of the cam follower (54), further comprising two laterally extending arms (56), the ends of which are adapted to act on the cross piece (40), and an inlet and outlet manifold (76) mounted in the casing (2) and rotationally stationary relative thereto and in contact with the second cover plate (16), the manifold (76) having at least one pair of inlet and outlet ducts (88) and ports (c) disposed so as to provide communication between the ports in the second cover plate and an inlet and outlet port respectively in the casing.

10 Claims, 4 Drawing Sheets

ROTARY VANE MACHINE

FIELD OF THE INVENTION

The present invention relates to a rotary-vane machine (RVM) for use as a compressor, a vacuum pump, a pneumatic motor, a liquid pump, a hydraulic motor or an internal combustion engine.

BACKGROUND ART

The disadvantages of the conventional reciprocating piston compressors and pumps are well-known: low ratio of power developed to machine mass and relatively low mechanical efficiency. The same holds true also for conventional rotary-laminar and screw compressors and pumps.

While V-type engines have a higher power/mass ratio, such designs as the Wankel engine have serious sealing problems even today.

There exists a rotary vane machine (U.S. Pat. No. 5,366,356) which comprises stationary end members connectable to one another, a rotor body rotating at uniform speed and having two first vanes, and two second vanes driven by the rotor body via a system of levers controlled by a camming mechanism, due to which the second vanes rotate at a periodically increasing and periodically decreasing speed. The serious disadvantage of this machine resides in the fact that the lever system making up the kinematic connection between the two types of vanes constitutes considerable inertial masses carrying out nonsymmetrical movements over large angular ranges, generating inertial forces exceeding the working load of the machine. The ensuing vibrations and noise preclude the construction of machines rotating at higher speeds.

DISCLOSURE OF THE INVENTION

It is thus one of the objects of the present invention to overcome the above disadvantage and to provide a mechanically efficient RVM generating minimal inertial forces and thus safely operable at high speeds.

According to the invention, the above object is achieved by providing a rotary-vane machine comprising a stationary shell including a casing member, a camming ring having an internal, non-circular camming surface, and a flange member; a rotor including at least two first vanes fixedly attached to, or integral with, said rotor, and adapted to rotate, together with said rotor, at uniform speed; a first cover plate fixedly attachable to said rotor and integral with a first shaft supported on its free end by bearing means mounted in said casing, and being provided with at least four ports for access or egress of a working medium; a second cover plate fixedly attachable to said rotor; a second shaft supported by first bearing means accommodated in said first cover plate and by second bearing means accommodated in said second cover plate; at least two second vanes fixedly attached to said second shaft and oscillatably accommodated within said rotor, and defining, together with said rotor, said first vanes and said first and second cover plate, a plurality of chambers; a cross piece integral with said second shaft and having at least one lateral projection mounting at least one block pivotable about a pivot; at least one third shaft eccentrically projecting from said second cover plate, the end portion of which shaft is connected to a coupling member for connection to a source of rotational power; at least one cam follower pivotably mounted between said second cover plate and said coupling member on said at least one third shaft and comprising two rollers riding along the internal surface of said cam follower, further comprising two laterally extending arms, the ends of which are adapted to act on said cross piece; an inlet and outlet manifold mounted in said casing and rotationally stationary relative thereto and in contact with said first cover plate, said manifold having at least one pair of inlet and outlet ducts and ports disposed so as to provide communication between said ports in said first cover plate and an inlet and outlet port respectively in said casing; wherein a rocking motion of a relatively small angular extent produced in said at least one cam follower when said rollers ride along said non-circular camming surface will cause said arms to superpose on said second vanes a rotary motion of a much larger extent that is alternatingly additive to the basic motion thereof, making said second vanes gain on said uniformly rotating first vanes, and subtracting therefrom, making said second vanes lag behind said uniformly rotating first vanes, whereby the volumes of each of two adjacent ones of said plurality of chambers, in a first cycle of phases, increase and respectively decrease, and, in a second cycle of phases, decrease and respectively increase.

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

DETAILED DESCRIPTION OF PREFERRED EMBODIMENTS

Figure 1:
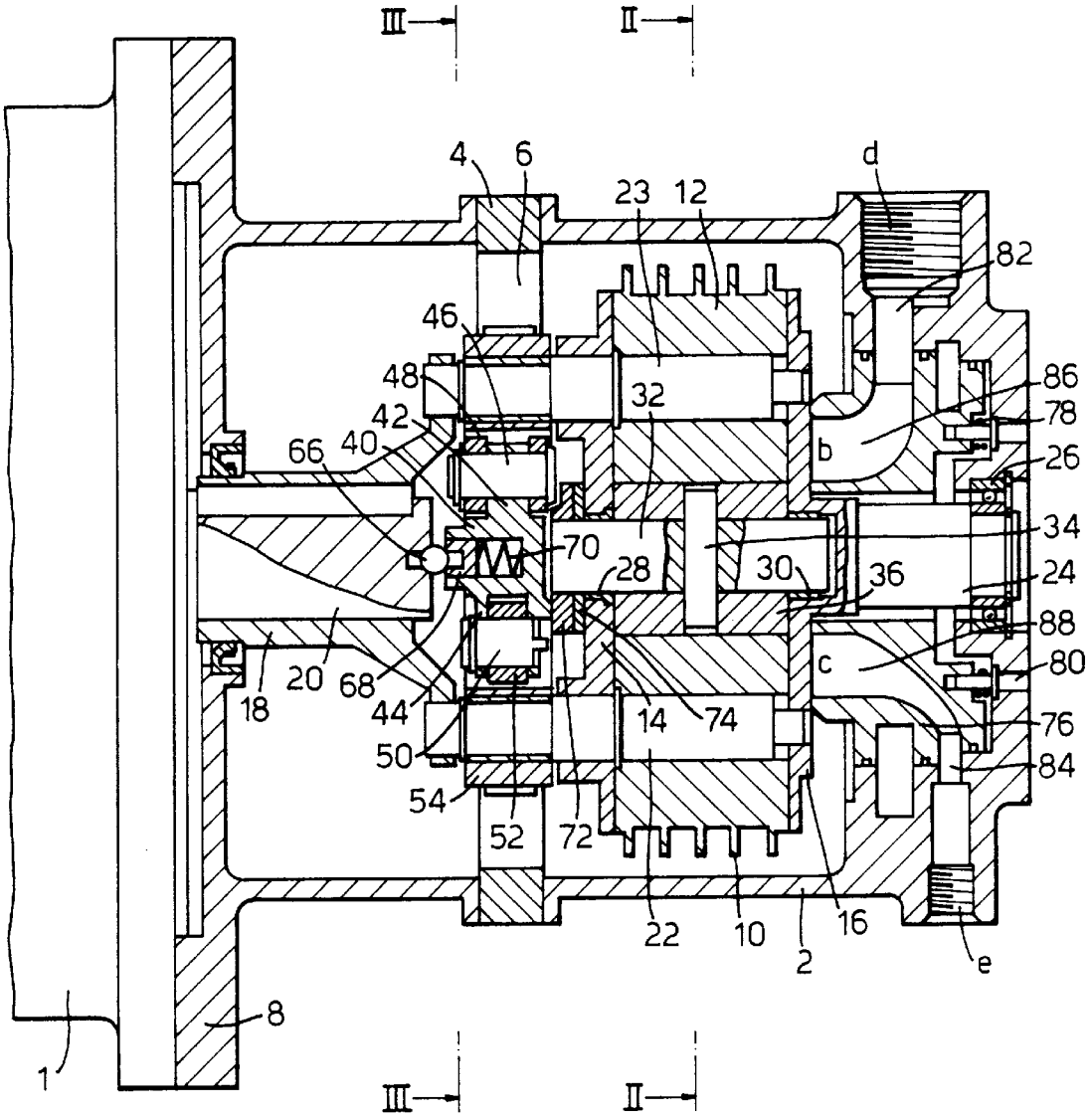
FIG. 1 is a general view in longitudinal cross-section of the rotary-vane machine according to the invention, as mounted on the flange of an electromotor or another machine.

In FIG. 1, the rotary-vane machine (RVM) is shown in a horizontal position, as mounted on the flange of an electric motor 1 or another machine. The shell of the RVM comprises a casing 2, a camming ring 4 with an internal, non-circular camming surface 6 and a flanged member 8, joined by conventional fastener means (not shown).

Figure 2:
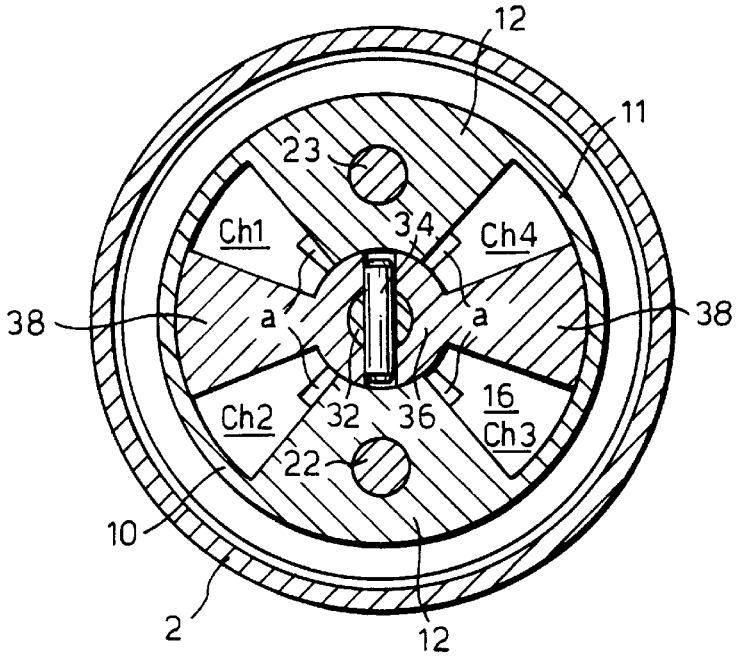
FIG. 2 is a cross-section along plane II—II in FIG. 1.

Inside the shell there is located rotor 10 (see also FIG. 2), which comprises also two tapering vanes 12 either integral with, or fixedly attached to, the wall 11 of rotor 10. Further seen is a first cover plate 14 and a second cover plate 16, both of which are connected to rotor 10 by conventional fastener means (not shown). Second cover plate 16 is provided with four ports a as inlets and outlets of the working medium. Rotor 10 and cover plates 14, 16 are connected to a coupling member 18 keyed to motor shaft 20 by means of shafts 22, 23. From this, it is clear that rotor 10 rotates at the uniform speed of motor 1.

Integral, or otherwise fixedly connected, with cover plate 16 is a shaft 24 supported in ball bearing 26, itself mounted in casing 2. Mounted in the center of first cover plate 14 and second cover plate 16, there are seen bearings 28 and 30 respectively, which support a shaft 32 (see also FIG. 2). Pinned to shaft 32 by pin 34 is hub 36 with which are integral, or to which are attached, two tapered vanes 38. Together with vanes 12, cover plates 14, 16, hub 36 and the inside of wall 11 of rotor 10, vanes 38 define four chambers $Ch_1$–$Ch_4$ (FIG. 2), the functions of which will be explained further below, as will be the function of four ports a in cover plate 16.

Shaft 32 is provided with a cross piece 40 having on one side a tongue-like projection 42 and on the other side a forked projection 44. Pivot 46 mounted in tongue-like projection 42 carries two blocks 48, while pivot 50 mounted in forked projection 44 carries a single block 52. The purpose of cross piece 40 and blocks 48, 52 will become apparent further below.

Figure 3:
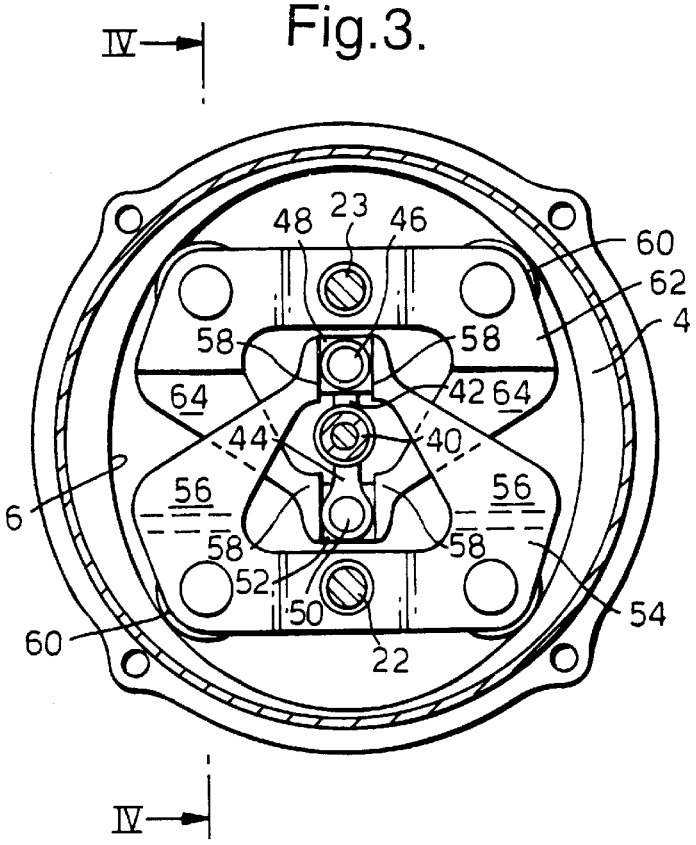
FIG. 3 is a cross-section along plane III—III in FIG. 1.
Figure 4:
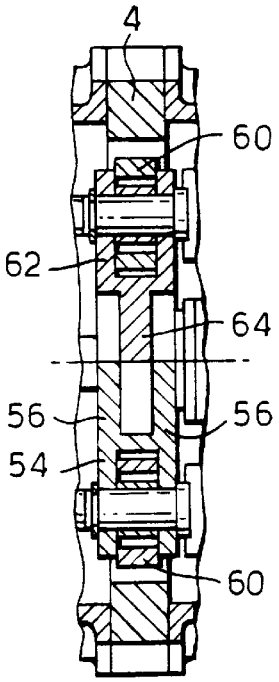
FIG. 4 is a longitudinal section along plane IV—IV in FIG. 3.

Referring now to FIGS. 3 and 4, there is seen a first cam follower 54 having two laterally extending arms 56 ending beyond the plane containing shaft 32 in substantially parallel jaws 58 which engage, and provide a sliding fit for, blocks 48. Cam follower 54, pivotably mounted on a reduced-diameter portion of shaft 22, is provided with rollers 60 which, when rotor 10 rotates, ride along the substantially elliptical camming surface 6 of camming ring 4.

Opposite to cam follower 54 there is located a second cam follower 62, equally pivotably mounted on a reduced-diameter portion of shaft 23, and provided with rollers 60 riding along camming surface 6.

The difference between cam followers 54 and 62 resides in the fact that cam follower 54 has, as it were, two pairs of arms 56, the pair seen in FIG. 3 and another pair hidden by, and at a distance from, the visible pair, as clearly seen in FIG. 4. Cam follower 62, in comparison, has only one pair of arms 64 which, as equally seen in FIG. 4, fits with clearance into the gap between the two pairs of arms 56 of cam follower 54.

Returning now to FIG. 1, there is seen a ball 66 abutting the center hole in motor shaft 20, a plunger 68 movable in a bore in cross piece 40 and a helical spring 70 abutting against plunger 68 and thus pressing cross piece 40 against pressure pad 72 and shims 74, which rotate together with cover plate 14 and are used to adjust the clearance between first and second cover plates 14, 16 and the plane surfaces of vanes 38.

Further seen in FIG. 1 is a stationary inlet and outlet manifold 76 sealingly seated in casing 2, pressed against cover plate 16 with the aid of springs 78 and prevented from rotating relative to casing 2 by means of pins 80.

Casing 2 is provided with one inlet port d and one outlet port e. Inlet port d leads into a first annular channel 82 provided partly in casing 2 and partly in manifold 76, and outlet port e leads into a second annular channel 84. From channel 82, ducts 86 lead to inlet ports b in the contact face of manifold 76 (see FIGS. 5, 6 and 7) and from channel 84, ducts 88 lead to outlet ports c in the contact face of manifold 76.

It is also seen that the annular surface constituting the right wall of annular channel 84 is smaller than that constituting the left wall thereof. Consequently, pressure prevailing in channel 84 produces a force vector which, in addition to springs 78, presses the stationary manifold 76 against the rotating second cover plate 16, thus enhancing the essential fluid tightness between manifold 76 and cover plate 16.

Figure 5:
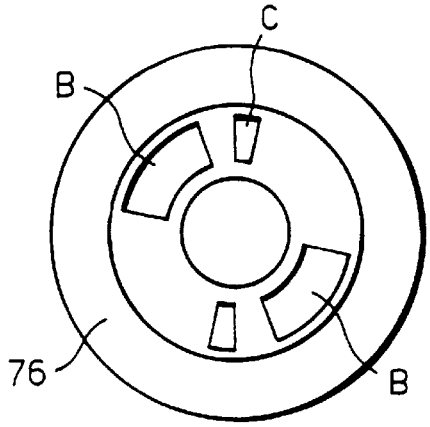
FIG. 5 shows the inlet and outlet manifold for a compressor, a vacuum pump and a pneumatic motor.

FIG. 5 shows the shape, number and relative size of inlet ports b and outlet ports c of a manifold 76 for an RVM to be used as a compressor, a vacuum pump or a pneumatic motor. It is seen that the angle subtended by outlet ports c is much smaller than that subtended by inlet ports b. This feature is important in order to achieve a high compression ratio.

Figure 6:
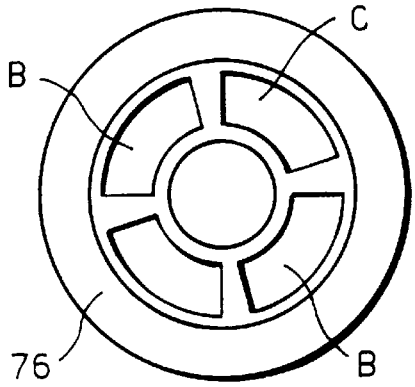
FIG. 6 shows the inlet and outlet manifold for a liquid pump and a hydraulic motor.

FIG. 6 shows the shape, number and relative size of inlet ports b and outlet ports c of a manifold 76 for an RVM to be used as a liquid pump or a hydraulic motor. Here, the angle subtended by inlet ports b and outlet ports c is equal, because of the incompressibility of liquids.

Figure 7:
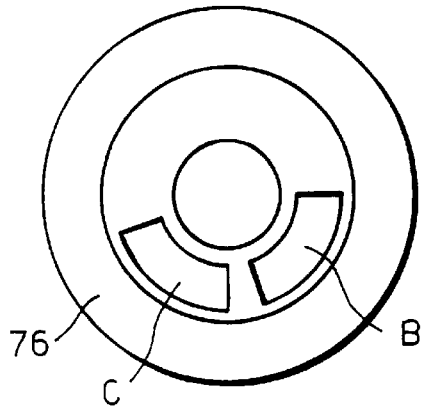
FIG. 7 shows the inlet and outlet manifold for an internal combustion engine.

FIG. 7 shows the shape, number and relative size of inlet ports b and outlet ports c of a manifold 76 for an RVM to be used as an internal combustion engine. Here, only two ports are needed, inlet port b for the induction cycle, and outlet port c for the exhaust cycle.

Figure 8A:
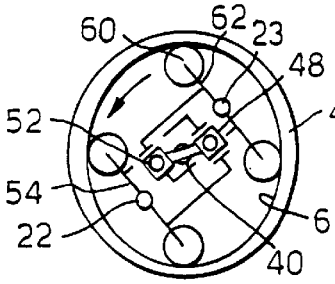
FIGS. 8*a*–8*j* represent several phases of the oscillating vanes in correlation with the corresponding positions of the camming mechanism.
Figure 8B:
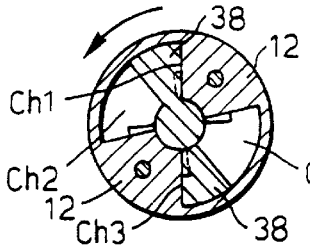
Figure 8C:
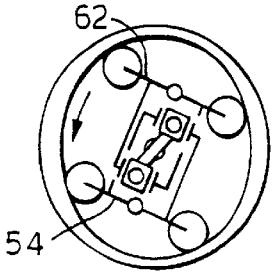
Figure 8D:
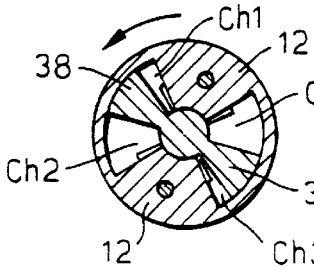
Figure 8E:
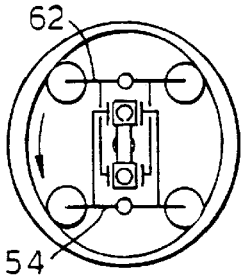
Figure 8F:
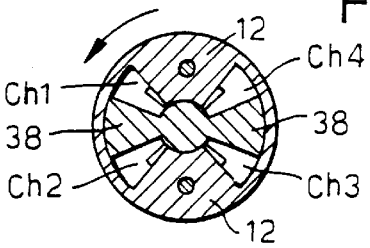
Figure 8G:
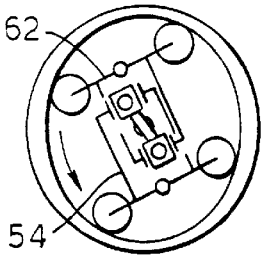
Figure 8H:
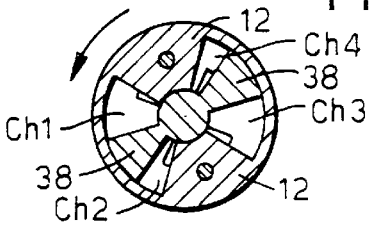
Figure 8I:
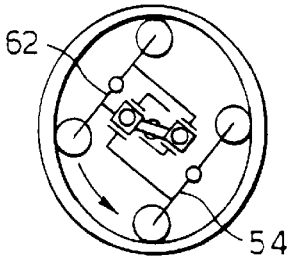
Figure 8J:
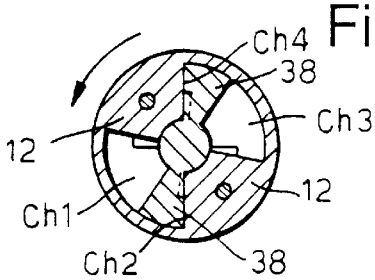

The rotary-vane machine described in detail in the aforegoing, when used as a compressor, a vacuum pump, a pneumatic motor, a liquid pump or as a hydraulic motor, operates as follows:

Via coupling member 18 and two shafts 22, 23, a motor shaft 20 drives rotor 10 and thus vanes 12, at uniform speed. Cam followers 54, 62, mounted on shafts 22, 23, also rotate about the central axis of the RVM, with their respective rollers 60 riding along the camming surface 6 and, because surface 6 is non-circular, superpose on the uniformly rotating movement of cam followers 54, 62 a rocking motion of a relatively small angular extent about shafts 22, respectively 23. Obviously, arms 56 and 64 participate in this rocking motion, which, because of the kinematics of the arrangement, causes jaws 54, via blocks 48, 52 to impart a rotary motion of a much larger extent to cross piece 40, which rotary motion is superposed on the uniform rotation of shaft 32 and thus on vanes 38. This superposed motion is additive to the basic rotation of vanes 38 in the first five phases illustrated in FIGS. 8*a*–8*j*, i.e., produces an acceleration that causes vanes 38 to gain on the uniformly rotating vanes 12, thereby increasing the volumes of chambers $Ch_1$, and $Ch_3$, while reducing the volumes of chambers $Ch_2$ and $Ch_4$. In the next five phases (which are not shown, but which are the analogue continuation of FIGS. 8*i* and 8*j*), the motion superposed on the basic uniform rotation of vanes 38 is subtractive, i.e., produces a deceleration that causes vanes 38 to lag behind vanes 12, thereby increasing the volumes of chambers $Ch_2$ and $Ch_4$, and reducing the volumes of chambers $Ch_1$ and $Ch_3$.

The working medium enters the chambers with increasing volume through port d in casing 2, ports b in manifold 76 and port a in cover plate 16, and exits the chambers with decreasing volume through port a in cover plate 16, ports c in manifold 76 and port e in casing 2.

In the RVM used as a carburetted or diesel-type internal combustion engine, at any instant an intake cycle is performed in one of the four chambers, a compression cycle in the second one, a power cycle in the third and an exhaust cycle in the fourth. Also provided are a spark plug, respectively an injection nozzle with an appropriately synchronized distributor, respectively injection pump system (not shown). During the induction cycle, port a of a first chamber is connected to port b of manifold 76 and port d of casing 2. In the second and third chambers, ports a are not connected to the ports of manifold 76 (see FIG. 7), and in the fourth chamber, port a is connected to port c of manifold 76 of casing 2. A starter motor (not shown) is required.

While the embodiment described comprises four chambers defined by four vanes, two rotating at uniform speed and two rotating at variable speed, embodiments are also envisaged having a different number of chambers and vanes.

Although the above embodiment was described as having two cam followers, light-duty RVM's will also work properly with a single cam follower, provided care is taken of proper dynamic balancing of the system.

When used in the compressor mode, it is possible to connect two or more RVM's in series, to obtain a multi-stage compressor.

It will be evident to those skilled in the art that the invention is not limited to the details of the foregoing illustrated embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A rotary-vane machine, comprising:

a stationary shell including a casing member, a camming ring having an internal, non-circular camming surface, and a flange member;

a rotor including at least two first vanes fixedly attached to, or integral with, said rotor, and adapted to rotate, together with said rotor, at uniform speed;

a first cover plate fixedly attachable to said rotor;

a second cover plate fixedly attachable to said rotor and integral with a first shaft supported on its free end by bearing means mounted in said casing, and being provided with at least four ports for access or egress of a working medium;

a second shaft supported by first bearing means accommodated in said first cover plate and by second bearing means accommodated in said second cover plate;

at least two second vanes fixedly attached to said second shaft and oscillatably accommodated within said rotor, and defining, together with said rotor, said first vanes and said first and second cover plate, a plurality of chambers;

a cross piece integral with said second shaft and having at least one lateral projection mounting at least one block pivotable about a pivot;

at least one third shaft eccentrically projecting from said second cover plate, the end portion of which shaft is connected to a coupling member for connection to a source of rotational power;

at least one cam follower pivotably mounted between said second cover plate and said coupling member on said at least one third shaft and comprising two rollers riding along the internal surface of said cam follower, further comprising two laterally extending arms, the ends of which are adapted to act on said cross piece;

an inlet and outlet manifold mounted in said casing and rotationally stationary relative thereto and in contact with said second cover plate, said manifold having at least one pair of inlet and outlet ducts and ports disposed so as to provide communication between said ports in said second cover plate and an inlet and outlet port respectively in said casing;

wherein a rocking motion of a relatively small angular extent produced in said at least one cam follower when said rollers ride along said non-circular camming surface will cause said arms to superpose on said second vanes a rotary motion of a much larger extent that is altematingly additive to the basic motion thereof, making said second vanes gain on said uniformly rotating first vanes, and subtracting therefrom, making said second vanes lag behind said uniformly rotating first vanes, whereby the volumes of each of two adjacent ones of said plurality of chambers, in a first cycle of phases, increase and respectively decrease, and, in a second cycle of phases, decrease and respectively increase.

2. The rotary-vane machine as claimed in claim 1, comprising two third shafts extending from said first cover plate in said first vanes and said second cover plate and including said end portions.

3. The rotary-vane machine as claimed in claim 1, comprising two cam followers, each mounted on one of said two third shafts.

4. The rotary-vane machine as claimed in claim 3, wherein the first one of said two cam followers has two pairs of arms in two spaced-apart planes, while the second one of said two cam followers has one pair of arms only, partly disposed between the two pairs of arms of said first cam follower.

5. The rotary-vane machine as claimed in claim 1, wherein said inlet and outlet ports provide communication between said ports in said second cover plate and said inlet and outlet port in said casing, respectively via a first and a second annular channel.

6. The rotary-vane machine as claimed in claim 1, wherein the walls of said second annular channel are configured in such a way that pressure prevailing in said second channel will produce a force vector pressing said manifold against said second cover plate.

7. The rotary-vane machine as claimed in claim 1, wherein clearance between said second vanes and said cover plates is set by means of a pressure pad and a shims member, and maintained by spring means acting on said cross piece.

8. The rotating-vane machine as claimed in claim 1, wherein, for gaseous media, the inlet ports in said manifold subtend a larger angle than the outlet ports.

9. The rotating-vane machine as claimed in claim 1, wherein for liquid working media or when used as an internal combustion engine, the inlet and outlet ports in said manifold subtend substantially identical angles.

10. The rotating-vane machine as claimed in claim 1, wherein said ends of said laterally extending arms are in the form of substantially parallel jaws adapted to act on said cross piece via said at least one block.

* * * * *